US005992422A

United States Patent [19]

Ivory

[11] Patent Number: 5,992,422

[45] Date of Patent: Nov. 30, 1999

[54] TOE NAIL POLISH REMOVING DEVICE

[76] Inventor: Linda F. Ivory, 123 Holy Cross Pl., Kenner, La. 70065

[21] Appl. No.: 09/325,276

[22] Filed: Jun. 3, 1999

[51] Int. Cl.[6] ..... A45D 29/00; A45D 29/18; A45D 29/05; A47L 1/02

[52] U.S. Cl. ..... 132/73; 132/73.5; 132/73.6; 15/97.1

[58] Field of Search ..... 132/73, 73.5, 73.6, 132/75, 75.3, 75.8, 76.2; 15/97.1, 21.1; 401/208

[56] References Cited

U.S. PATENT DOCUMENTS

| | | | |
|---|---|---|---|
| 2,922,261 | 1/1960 | Rabkin et al. | 132/73.6 |
| 4,137,929 | 2/1979 | Grossman | 132/73 |
| 4,255,826 | 3/1981 | Boyd | 132/73.6 |
| 4,319,596 | 3/1982 | Jackson | 132/73.6 |
| 4,474,195 | 10/1984 | Warner | 132/73 |
| 4,510,954 | 4/1985 | Miller | 132/75 |
| 4,627,758 | 12/1986 | Winthrop | 401/208 |
| 5,007,441 | 4/1991 | Goldstein | 132/73.6 |
| 5,139,036 | 8/1992 | Pickard | 132/73.5 |
| 5,339,477 | 8/1994 | Warner et al. | 15/97.1 |
| 5,379,474 | 1/1995 | Nakamura | 15/21.1 |
| 5,769,099 | 6/1998 | Davis et al. | 132/73.6 |

*Primary Examiner*—John J. Wilson
*Assistant Examiner*—Robyn K Doan
*Attorney, Agent, or Firm*—Joseph N. Breaux

[57] ABSTRACT

A device for removing toe nail polish that operates while the user sits or stands with one or more feet in the device with the toe nails of the feet/foot positioned beneath a toe nail polish remover assembly including a toe nail polish removing sponge that is periodically refilled with nail polish remover from a reservoir and that moves back and forth in a reciprocating motion across the user's toes.

2 Claims, 2 Drawing Sheets

TOE NAIL POLISH REMOVING DEVICE

TECHNICAL FIELD

The present invention relates to nail polish removing devices and more particularly to a toe nail polish removing device that includes a housing including a foot placement area partially defined between slanted sidewalls, and a nail polish remover fill opening in connection with a nail polish remover reservoir positioned over a reciprocating sponge assembly including a reciprocating motor assembly in connection with and reciprocating in a back and forth motion an open celled polish removal sponge that is detachably securable to a sponge support plate rigidly secured to an actuator arm of the reciprocating motor assembly; the nail polish removing reservoir having a bottom defined by a bottom structure having a reservoir emptying opening formed entirely therethrough; the sponge support plate being slidably mounted between two guide members beneath the nail polish remover reservoir and in sealing relationship with a downward facing surface of the bottom structure and supporting the open celled polish removal sponge from a bottom surface thereof within a toe positioning area of the foot placement area of the housing; the sponge support plate further including a sponge feed opening formed entirely therethrough that is periodically in alignment with the reservoir emptying opening formed in connection with the nail polish remover reservoir when the sponge support plate is reciprocating between a left most position and a right most position to provide a nail polish remover transfer mechanism for transferring nail polish remover from the nail polish remover reservoir to the open celled polish removal sponge; the sponge support plate including two sponge clips on the ends thereof for securing the open celled polish removal sponge to the sponge support plate.

Background Art

It is difficult for some women to remove toe nail polish from toe nails because of back injuries and the like. It would be a benefit to these women to have a device for removing toe nail polish that operated while the women sat or stood with one or more feet in the device with the toe nails of the feet positioned beneath a toe nail polish remover assembly including a toe nail polish removing sponge that was periodically refilled with nail polish remover from a reservoir and that moved back and forth in a reciprocating motion across the user's toes.

GENERAL SUMMARY DISCUSSION OF INVENTION

It is thus an object of the invention to provide a toe nail polish removing device that includes a housing including a foot placement area partially defined between slanted sidewalls, and a nail polish remover fill opening in connection with a nail polish remover reservoir positioned over a reciprocating sponge assembly including a reciprocating motor assembly in connection with and reciprocating in a back and forth motion an open celled polish removal sponge that is detachably securable to a sponge support plate rigidly secured to an actuator arm of the reciprocating motor assembly; the nail polish removing reservoir having a bottom defined by a bottom structure having a reservoir emptying opening formed entire ly therethrough; the sponge support plate being slidably mounted between two guide members beneath the nail polish remover reservoir and in sealing relationship with a downward facing surface of the bottom structure and supporting the open celled polish removal sponge from a bottom surface thereof within a toe positioning area of the foot placement area of the housing; the sponge support plate further including a sponge feed opening formed entirely therethrough that is periodically in alignment with the reservoir emptying opening formed in connection with the nail polish remover reservoir when the sponge support plate is reciprocating between a left most position and a right most position to provide a nail polish remover transfer mechanism for transferring nail polish remover from the nail polish remover reservoir to the open celled polish removal sponge; the sponge support plate including two sponge clips on the ends thereof for securing the open celled polish removal sponge to the sponge support plate.

Accordingly, a toe nail polish removing device is provided. The toe nail polish removing device includes a housing including a foot placement area partially defined between slanted sidewalls, and a nail polish remover fill opening in connection with a nail polish remover reservoir positioned over a reciprocating sponge assembly including a reciprocating motor assembly in connection with and reciprocating in a back and forth motion an open celled polish removal sponge that is detachably securable to a sponge support plate rigidly secured to an actuator arm of the reciprocating motor assembly; the nail polish removing reservoir having a bottom defined by a bottom structure having a reservoir emptying opening formed entirely therethrough; the sponge support plate being slidably mounted between two guide members beneath the nail polish remover reservoir and in sealing relationship with a downward facing surface of the bottom structure and supporting the open celled polish removal sponge from a bottom surface thereof within a toe positioning area of the foot placement area of the housing; the sponge support plate further including a sponge feed opening formed entirely therethrough that is periodically in alignment with the reservoir emptying opening formed in connection with the nail polish remover reservoir when the sponge support plate is reciprocating between a left most position and a right most position to provide a nail polish remover transfer mechanism for transferring nail polish remover from the nail polish remover reservoir to the open celled polish removal sponge; the sponge support plate including two sponge clips on the ends thereof for securing the open celled polish removal sponge to the sponge support plate.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
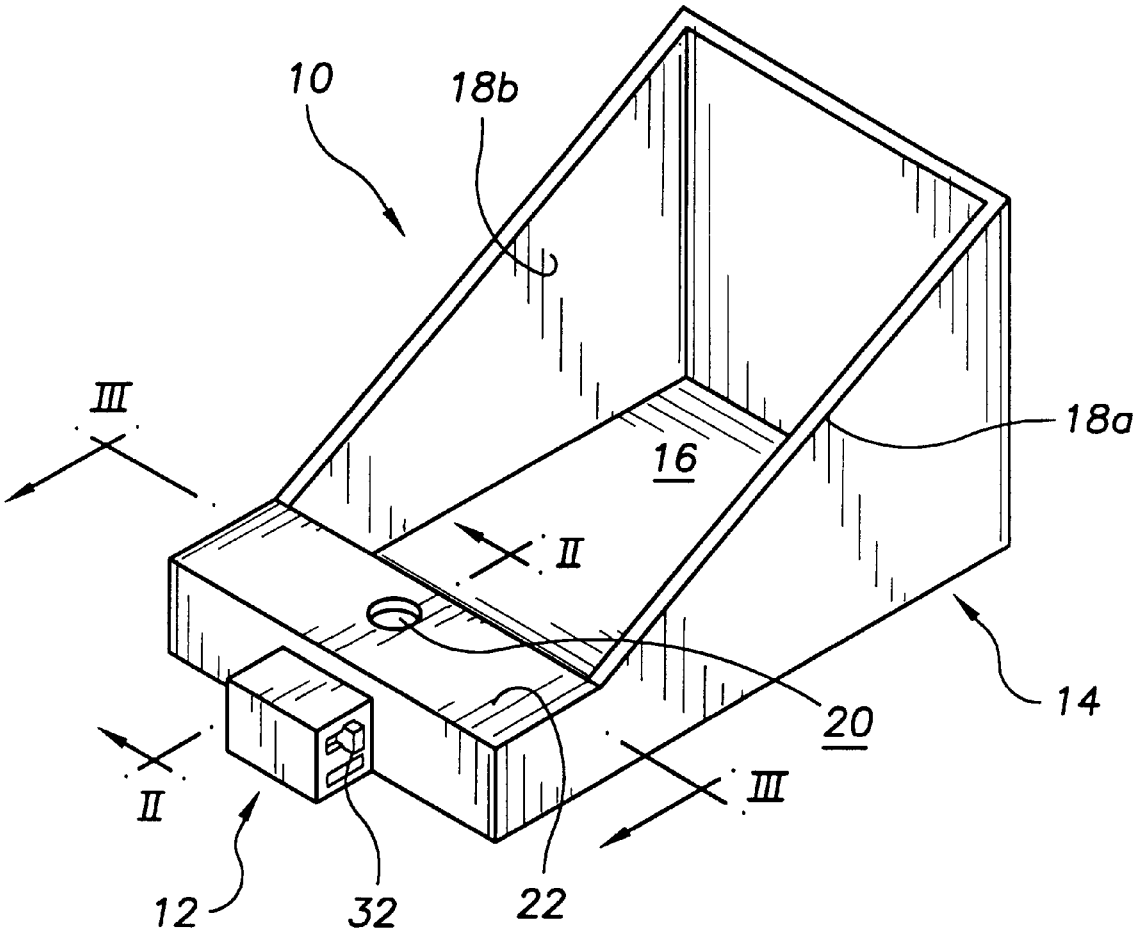
FIG. 1 is a perspective view of an exemplary embodiment of the toe nail polish removing device of the present invention showing a housing including a foot placement area partially defined between slanted sidewalls, and a nail polish remover fill opening in connection with a nail polish remover reservoir positioned over a reciprocating sponge assembly including a reciprocating motor assembly in connection with and reciprocating in a back and forth motion an open celled polish removal sponge that is detachably securable to a sponge support plate rigidly secured to an actuator arm of the reciprocating motor assembly; the nail polish removing reservoir having a bottom defined by a bottom structure having a reservoir emptying opening formed entirely therethrough; the sponge support plate being slidably mounted between two guide members beneath the nail polish remover reservoir and in sealing relationship with a downward facing surface of the bottom structure and supporting the open celled polish removal sponge from a bottom surface thereof within a toe positioning area of the foot placement area of the housing; the sponge support plate further including a sponge feed opening formed entirely therethrough that is periodically in alignment with the reservoir emptying opening formed in connection with the nail polish remover reservoir when the sponge support plate is reciprocating between a left most position and a right most position to provide a nail polish remover transfer mechanism for transferring nail polish remover from the nail polish remover reservoir to the open celled polish removal sponge.
Figure 2:
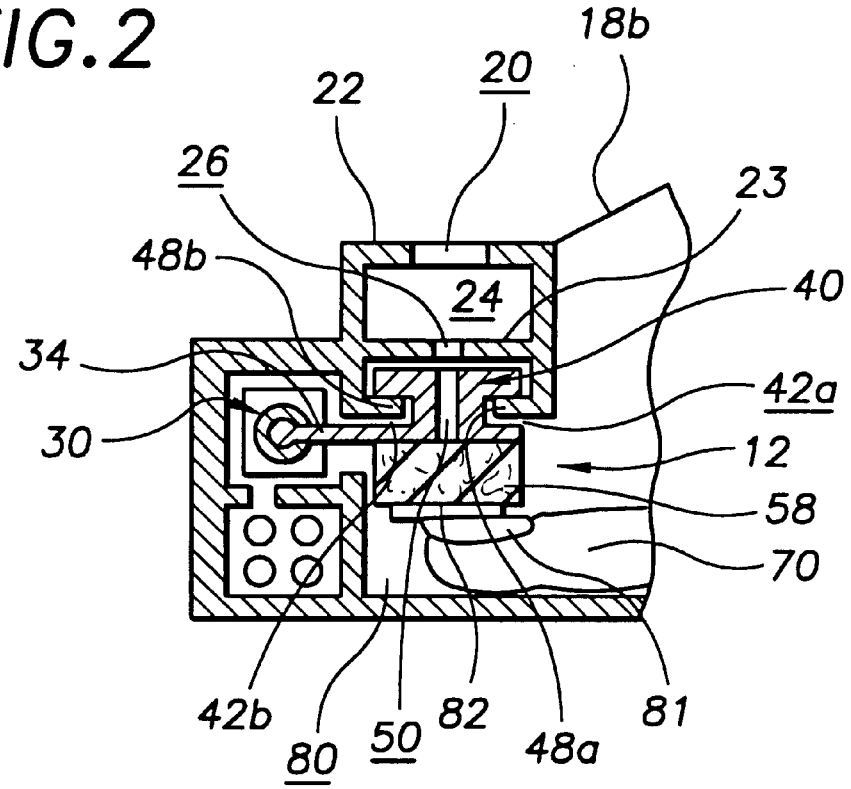
FIG. 2 is a cross sectional view of the exemplary toe nail polish removing device of FIG. 1 along the line II—II showing the toe of a user positioned within the toe positioning area of the foot placement area and against a bottom surface of nail polish remover saturated open celled polish removal sponge; the nail polish remover fill opening in connection with the nail polish remover reservoir; the reciprocating sponge assembly including the reciprocating motor assembly, the sponge support plate slidably mounted on the two guide members beneath the nail polish remover reservoir, the open celled polish removal sponge detachably secured to the sponge support plate; and the sponge feed opening of the sponge support plate being aligned with the reservoir emptying opening of the nail polish remover reservoir.

FIG. 1 shows an exemplary embodiment of the toe nail polish removing device of the present invention generally designated 10. Toe nail polish removing device 10 includes a reciprocating sponge assembly, generally designated 12, and a housing, generally designated 14. Housing 14 is of molded plastic construction and includes a foot placement area 16 partially defined between slanted sidewalls 18*a*,18*b* sized to simultaneously receive both feet of a user. A nail polish remover fill opening 20 is provided through a top section 22 thereof that is in connection, referring now to FIG. 2, with a nail polish remover reservoir 24 having a bottom 23 positioned over reciprocating sponge assembly 12. Bottom 23 has a reservoir emptying opening 26 formed entirely therethrough.

Figure 3:
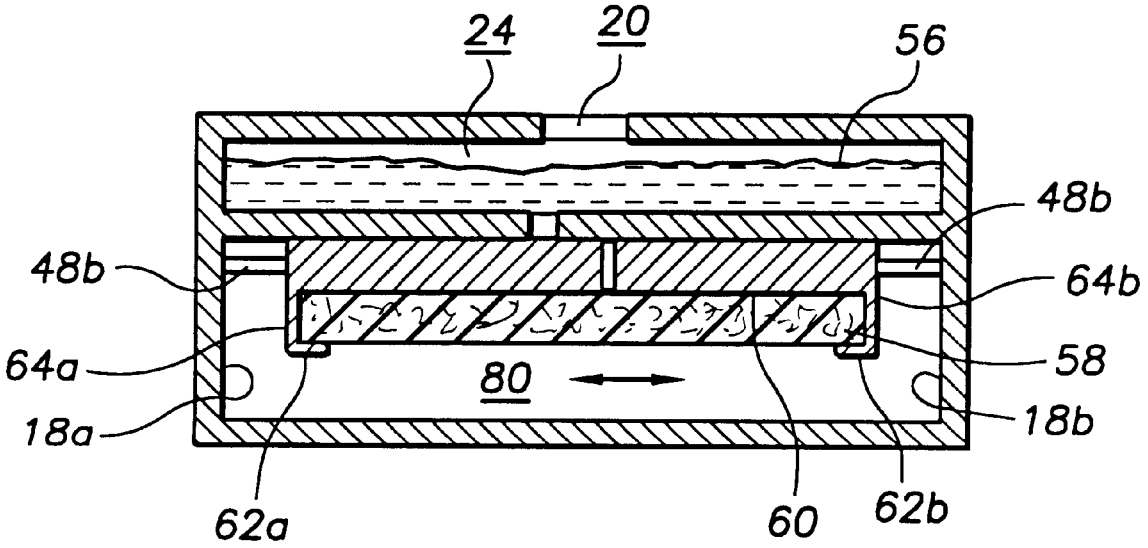
FIG. 3 is a cross sectional view of the exemplary toe nail polish removing device of FIG. 1 along the line III—III showing the the toe positioning area of the foot placement area; the nail polish remover fill opening in connection with the nail polish remover reservoir; the sponge support plate, one of the two guide members; the open celled polish removal sponge detachably secured to the sponge support plate with two sponge clips on the ends of the sponge support plate; and the sponge feed opening of the sponge support plate out of alignment with the reservoir emptying opening of the nail polish remover filled nail polish remover reservoir.

Reciprocating sponge assembly 12 includes a reciprocating motor assembly, generally designated 30, having a speed controller 32 (FIG. 1) controlling the back and forth frequency of an actuator arm 34 that is rigidly attached to a sponge support plate, generally designated 40. Sponge support plate 40 has two glide channels 42*a*,42*b* formed along the entire length thereof that are each slidably engaged with an L-shaped guide member 48*a*,48*b* respectively in a manner to hold sponge support plate 40 in sliding sealing relationship with reservoir emptying opening 26. Sponge support plate 40 has a sponge feed opening 50 formed entirely therethrough that in use is periodically in alignment with reservoir emptying opening 26 to provide a nail polish remover transfer mechanism for transferring, with reference now to FIG. 3, nail polish remover 56 from nail polish remover reservoir 24 to an open celled polish removal sponge 58 that is detachably secured to a bottom surface 60 of sponge support plate 40 with two sponge clips 62*a*,62*b* on the ends 64*a*,64*b* of sponge support plate 40. Support sponge plate 40 reciprocates back and forth driven by reciprocating motor assembly 30 (FIG. 2) between a left most position with end 64*a* in contact with wall 18*a* and a right most position with end 64*b* in contact with wall 18*b*.

Referring back to FIG. 2, in use the user positions a toe 70 within a toe positioning area 80 of foot placement area 16 (FIG. 1) with the toe nail 81 pushed against a bottom surface 82 of nail polish remover saturated open celled polish removal sponge 58. The reciprocating action and the nail polish remover cause the polish to be stripped rapidly and completely from toe nail 81.

It can be seen from the preceding description that a toe nail polish removing device has been provided that includes a housing including a foot placement area partially defined between slanted sidewalls, and a nail polish remover fill opening in connection with a nail polish remover reservoir positioned over a reciprocating sponge assembly including a reciprocating motor assembly in connection with and reciprocating in a back and forth motion an open celled polish removal sponge that is detachably securable to a sponge support plate rigidly secured to an actuator arm of the reciprocating motor assembly; the nail polish removing reservoir having a bottom defined by a bottom structure having a reservoir emptying opening formed entirely therethrough; the sponge support plate being slidably mounted between two guide members beneath the nail polish remover reservoir and in sealing relationship with a downward facing surface of the bottom structure and supporting the open celled polish removal sponge from a bottom surface thereof within a toe positioning area of the foot placement area of the housing; the sponge support plate further including a sponge feed opening formed entirely therethrough that is periodically in alignment with the reservoir emptying opening formed in connection with the nail polish remover reservoir when the sponge support plate is reciprocating between a left most position and a right most position to provide a nail polish remover transfer mechanism for transferring nail polish remover from the nail polish remover reservoir to the open celled polish removal sponge; the sponge support plate including two sponge clips on the ends thereof for securing the open celled polish removal sponge to the sponge support plate.

It is noted that the embodiment of the toe nail polish removing device described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A toe nail polish removing device comprising:

a reciprocating sponge assembly; and a housing including a foot placement area partially defined between slanted sidewalls, and a nail polish remover fill opening in connection with a nail polish remover reservoir positioned over said reciprocating sponge assembly;

said reciprocating sponge assembly including a reciprocating motor assembly in connection with and in operation reciprocating in a back and forth motion an open celled polish removal sponge that is detachably securable to a sponge support plate rigidly secured to an actuator arm of said reciprocating motor assembly;

said nail polish removing reservoir having a bottom defined by a bottom structure having a reservoir emptying opening formed entirely therethrough;

said sponge support plate being slidably mounted between two guide members beneath said nail polish remover reservoir and in sealing relationship with a downward facing surface of said bottom structure and supporting said open celled polish removal sponge from a bottom surface thereof within a toe positioning area of said foot placement area of said housing;

said sponge support plate further including a sponge feed opening formed entirely therethrough that is periodically in alignment with said reservoir emptying opening formed in connection with said nail polish remover reservoir when said sponge support plate is reciprocating between a left most position and a right most position to provide a nail polish remover transfer mechanism for transferring nail polish remover from said nail polish remover reservoir to said open celled polish removal sponge.

2. The toe nail polish removing device of claim 1 wherein:

said sponge support plate includes two sponge clips on said ends thereof for securing said open celled polish removal sponge to said sponge support plate.

* * * * *